US010088278B1

(12) United States Patent
Tanielian

(10) Patent No.: US 10,088,278 B1
(45) Date of Patent: Oct. 2, 2018

(54) ELECTROMAGNETIC PULSE (EMP) GENERATION

(71) Applicant: THE BOEING COMPANY, Chicago, IL (US)

(72) Inventor: Minas H. Tanielian, Bellevue, WA (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 15/498,148

(22) Filed: Apr. 26, 2017

(51) Int. Cl.
*F41H 13/00* (2006.01)

(52) U.S. Cl.
CPC ..... *F41H 13/0093* (2013.01)

(58) Field of Classification Search
CPC ..... F41H 13/0093; F42B 1/00; F42B 12/36
USPC ..... 89/102, 1.14; 102/378
See application file for complete search history.

(56) References Cited

U.S. PATENT DOCUMENTS 3,150,848 A * 9/1964 Lager ..... B64D 1/16 102/351
3,221,875 A * 12/1965 Paquette ..... H01Q 15/145 102/357
3,754,256 A * 8/1973 Nystrom ..... G01S 7/38 342/12
3,878,524 A * 4/1975 Olstowski ..... H01Q 15/145 342/5
4,430,577 A 2/1984 Bouquet
4,756,778 A * 7/1988 Deitz ..... C06D 3/00 102/334
4,845,378 A 7/1989 Garbe et al.
5,337,671 A * 8/1994 Varmo ..... F42B 12/48 102/334
5,656,794 A * 8/1997 Krone ..... C06D 3/00 102/334
5,972,506 A * 10/1999 Leichter ..... C06C 15/00 252/506
6,578,492 B1 * 6/2003 Koch ..... C06D 3/00 102/334
6,635,130 B2 * 10/2003 Koch ..... C06B 27/00 149/108.2
7,343,861 B1 * 3/2008 Baker ..... F41J 2/02 102/336
2017/0222265 A1 * 8/2017 Inoue ..... H01M 10/0567

OTHER PUBLICATIONS

Basu, et al., "Synthesis and properties of lithium-graphite intercalation compounds", Materials Science and Engineering, 38, 1979, pp. 275-283.
Guerard, et al., "Intercalation of Lithium into graphite and other carbons", Carbon, 1975, vol. 13, pp. 337-345.
Zannini, et al., "Alternate synthesis and reflectivity spectrum of stage 1 lithium-graphite intercalation compound", Carbon, vol. 16, Issue 3, 1978, pp. 211-212.

(Continued)

*Primary Examiner* — Joshua E Freeman
(74) *Attorney, Agent, or Firm* — Toler Law Group, P.C.

(57) ABSTRACT

An apparatus includes charged-particle intercalated graphite. The apparatus additionally includes one or more explosive materials disposed within a region defined by the charged-particle intercalated graphite.

20 Claims, 6 Drawing Sheets

(56) References Cited

OTHER PUBLICATIONS

Kopp, Carlo, "The Electromagnetic Bomb—a Weapon of Electrical Mass Destruction," downloaded Apr. 30, 2018, <https://www.globalsecurity.org/military/library/report/1996/apjemp.htm>, 29 pgs.
Wictor, Thomas, "Ordnance that will end major wars. Thank Israel," downloaded Apr. 30, 2018, <http://thmaswictor.com/ordnance-that-will-end-all-wars-thank-Israel,> 10 pgs.

* cited by examiner

ELECTROMAGNETIC PULSE (EMP) GENERATION

FIELD OF THE DISCLOSURE

The present disclosure relates to generating an electromagnetic pulse.

BACKGROUND

Electromagnetic pulses (EMPs) may be generated by nuclear or non-nuclear techniques. Nuclear techniques generate EMPs by explosion of nuclear bombs. Explosion of nuclear bombs creates substantial amounts of blast energy, thermal energy, and nuclear radiation, making nuclear techniques unsuitable for deployment in situations that call for limited blast energy, thermal energy, or nuclear radiation. Additionally, nuclear bombs are expensive to make. Non-nuclear techniques include a large low-inductance capacitor bank discharged into a single-loop antenna, a microwave generator, and an explosively pumped flux compression generator. While EMPs may be generated by non-nuclear electronically generated techniques, such techniques are not suited for compact delivery, requiring these techniques to be deployed from a substantial distance away from targets, where the electronic signals are generated. Deploying these non-nuclear techniques from a substantial distance from targets renders these techniques subject to large attenuation losses, typically requiring these techniques to employ highly directive technologies to direct EMP radiation toward the targets, which can make these techniques often expensive, massive, and stationary.

SUMMARY

In some implementations, an apparatus includes charged-particle intercalated graphite. The apparatus additionally includes one or more explosive materials disposed within a region defined by the charged-particle intercalated graphite.

In some implementations, a method of generating an electromagnetic pulse includes releasing charged particles from charged-particle intercalated graphite responsive to detonation of one or more explosive materials proximate to the charged-particle intercalated graphite. The method additionally includes emitting, by the released charged particles, electromagnetic energy.

In some implementations, an apparatus includes means for storing charged particles. The apparatus additionally includes means for detonating disposed within a region defined by the means for storing charged particles.

The features, functions, and advantages described herein can be achieved independently in various embodiments or may be combined in yet other embodiments, further details of which are disclosed with reference to the following description and drawings.

DETAILED DESCRIPTION

Particular embodiments of the present disclosure are described below with reference to the drawings. In the description, common features are designated by common reference numbers throughout the drawings.

The figures and the following description illustrate specific exemplary embodiments. It will be appreciated that those skilled in the art will be able to devise various arrangements that, although not explicitly described or shown herein, embody the principles described herein and are included within the scope of the claims that follow this description. Furthermore, any examples described herein are intended to aid in understanding the principles of the disclosure and are to be construed as being without limitation. As a result, this disclosure is not limited to the specific embodiments or examples described below, but by the claims and their equivalents.

Examples described herein include a device that generates an electromagnetic pulse (EMP). Examples of the device include charged-particle intercalated graphite and non-nuclear explosive material. Examples of the device are configured to generate the EMP using a blast from detonation of the non-nuclear explosive to liberate charged particles from the charged-particle intercalated graphite and to accelerate the liberated charged particles. Acceleration of the liberated charged particles produces electromagnetic (EM) energy of the EMP.

In some examples, the device that generates the EMP is sufficiently compact to be packaged within a propelled munition, such as a missile, mortar or a hand-grenade. In these examples, the device that generates the EMP can be delivered to a target from a station or vehicle that is remotely located from the target. In these examples, because the device that generates the EMP can be delivered close to the target, attenuation of the EM energy of the EMP as the pulse propagates away from the device may be less problematic than with devices that are not deliverable within close proximity to a target.

In some examples, the non-nuclear explosive is low-cost, resulting in a low-cost EMP munition. Some examples include a hollow conductor (e.g., a resonant cavity) to tune the EMP. For example, a device may include a hollow conductor that uses resonance to amplify (or self-reinforce) particular frequencies of EM energy produced by accelerated liberated charged particles. In some examples, the particular frequencies amplified by the hollow conductor include microwave frequencies.

Figure 1A:
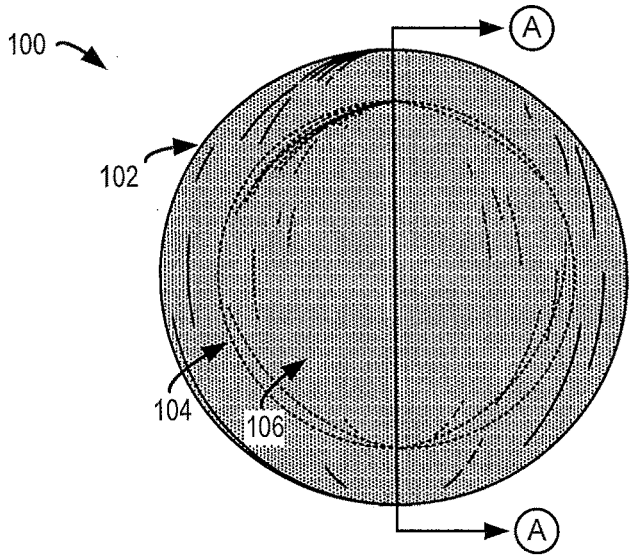
FIG. 1A illustrates a front view of an example of an apparatus that includes charged-particle intercalated graphite and one or more explosive materials.
Figure 1B:
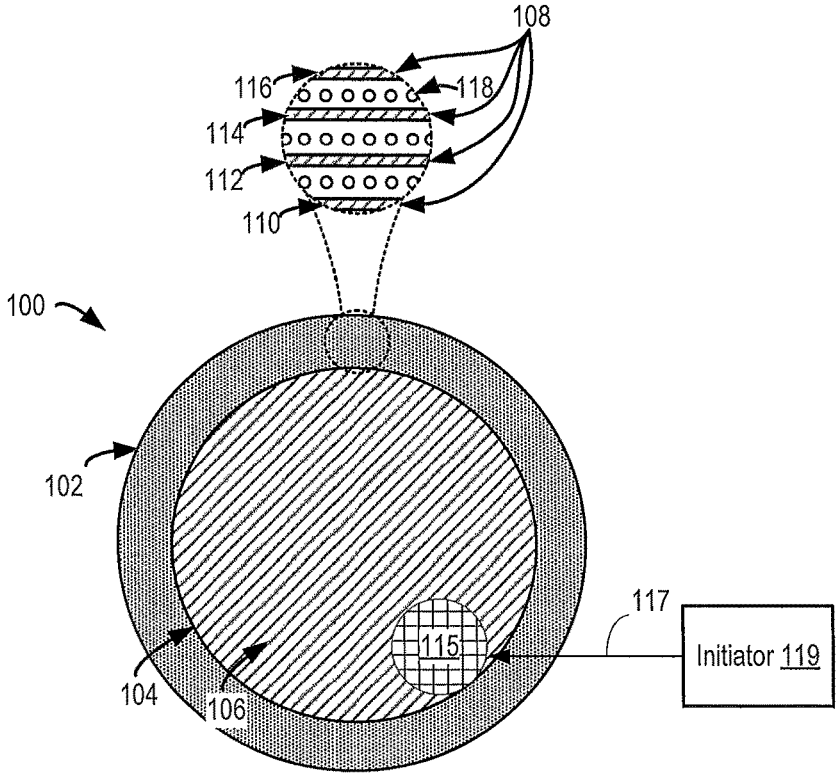
FIG. 1B illustrates a cross-sectional view of the apparatus of FIG. 1A along line A-A of FIG. 1A.

FIG. 1A illustrates a front view of an example of an apparatus 100 configured to generate an EMP. The apparatus 100 includes charged-particle intercalated graphite 102 and one or more explosive materials 104 disposed within a region 106 defined by the charged-particle intercalated graphite 102. FIG. 1B illustrates a cross-sectional view of the apparatus 100 of FIG. 1A along the line A-A of FIG. 1A and includes a detail view of a portion of the intercalated graphite 102.

The charged-particle intercalated graphite 102 includes charged particles 118 and graphite 108 that includes multiple layers 110, 112, 114, 116 of graphite material. The charged particles 118 are intercalated into (e.g., reversibly included in) the graphite 108 (e.g., between the layers 110, 112, 114, 116 of graphite material). In some examples, the charged-particle intercalated graphite 102 includes (e.g., the charged particles 118 include) alkali metal. In some examples, the charged particles 118 correspond to or include ions (e.g., alkali metal ions). To illustrate, in some examples, the charged particles 118 include lithium ions, cesium ions, potassium ions, or a combination thereof. Additionally or alternatively, in some examples, the charged-particle intercalated graphite 102 includes (e.g., the charged particles 118 include) bromine. In some examples, the charged particles 118 are intercalated into the graphite 108 electrolytically or via immersion of graphite powder in a liquid form of the material of the charged particles 118. For example, in some implementations, the charged particles 118 are intercalated into the graphite 108 by immersing the graphite 108 into liquid lithium, liquid cesium, liquid potassium, or liquid bromine.

The charged-particle intercalated graphite 102 defines the region 106 within which the one or more explosive materials 104 are disposed. In some examples, the region 106 is fully enclosed by the charged-particle intercalated graphite 102. In other examples, the region 106 is defined by the charged-particle intercalated graphite 102 without being fully enclosed by the charged-particle intercalated graphite 102. For example, in some implementations, the charged-particle intercalated graphite 102 includes one or more slots, apertures, or gaps, and the region 106 corresponds to a region that would be fully enclosed by the charged-particle intercalated graphite 102 if the charged-particle intercalated graphite 102 did not include the one or more slots, apertures, or gaps. To illustrate, in some examples, the charged-particle intercalated graphite 102 includes one or more slots, apertures, or gaps, to provide an initiator 119 access to a detonator 115 disposed within the region 106.

In the example illustrated in FIGS. 1A and 1B, the charged-particle intercalated graphite 102 is arranged or formed in a spherical shape. In other examples, the charged-particle intercalated graphite 102 is arranged or formed in a shape other than a sphere. In some examples, the charged-particle intercalated graphite 102 is arranged in a cylindrical shape or a box shape.

The one or more explosive materials 104 may include or form one or more explosive charges. In the example illustrated in FIGS. 1A and 1B, the charged-particle intercalated graphite 102 is wrapped around the one or more explosive materials 104 (e.g., wrapped around the one or more explosive charges). However, in other examples, the charged-particle intercalated graphite 102 is spaced apart from the one or more explosive materials 104 (e.g., spaced apart from the one or more explosive charges).

In some examples, the apparatus 100 includes detonation components, such as the detonator 115 and the initiator 119 (e.g., a fuse), configured to trigger detonation of the one or more explosive materials 104. The initiator 119 may provide an input 117 to trigger the detonator 115. In some examples, the initiator 119 is configured to be mechanically triggered. In these examples, the initiator 119 is configured to provide the input 117 (e.g., activation energy) to initiate detonation of the one or more explosive materials 104 (e.g., initiate detonation of the one or more charges) in response to impact of the apparatus 100 (or impact of a delivery system that includes the apparatus 100, such as a missile) with a target. Additionally or alternatively, the initiator 119 may be configured to provide the input 117 to trigger explosion of the one or more explosive materials 104 based on a timed sequence.

The one or more explosive materials 104 are configured to undergo non-nuclear explosive detonation. For example, the one or more explosive materials 104 are configured to store potential energy in the form of chemical energy as opposed to nuclear energy. As an example, the one or more explosive materials 104 may include trinitrotoluene (TNT), cyclotrimethylenetrinitramine (RDX), octogen (HMX), or a combination thereof.

The charged-particle intercalated graphite 102 is configured to undergo exfoliation (e.g., separation of the graphitic layers of the 102) in response to detonation of the one or more explosive materials 104. In some examples, the one or more explosive materials 104 and the charged-particle intercalated graphite 102 are configured such that thermal energy, mechanical energy, or a combination thereof, from detonation of the one or more explosive materials 104, causes the charged-particle intercalated graphite 102 to undergo thermal exfoliation, mechanical exfoliation, or a combination thereof.

Figure 2:
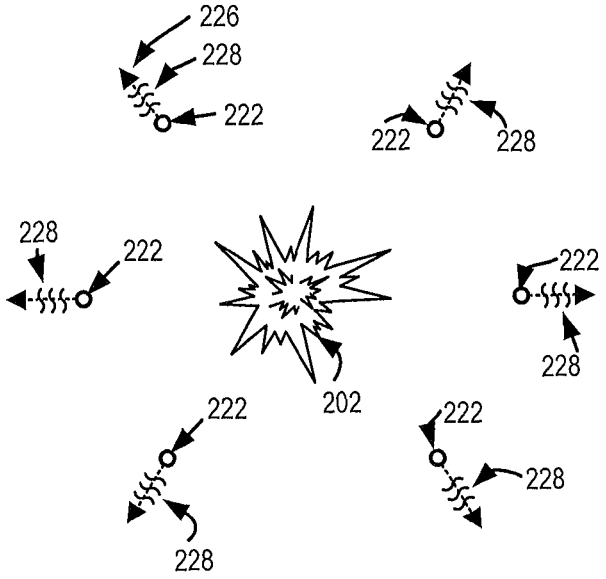
FIG. 2 illustrates an example of detonation of the one or more explosive materials of FIGS. 1A and 1B and electromagnetic energy produced by acceleration of charged particles released by the charged-particle intercalated graphite of FIGS. 1A and 1B responsive to the detonation.

Exfoliation of the charged-particle intercalated graphite 102 responsive to detonation of the one or more explosive materials 104 results in deintercalation (e.g., expulsion or removal) of at least some of the charged particles 118 from the charged-particle intercalated graphite 102. To illustrate, FIG. 2 depicts detonation 202 of the one or more explosive materials 104 of FIGS. 1A and 1B and depicts released charged particles 222 that are deintercalated responsive to exfoliation of the charged-particle intercalated graphite 102 of FIGS. 1A and 1B.

Thus, the exfoliation of the charged-particle intercalated graphite 102 in response to the detonation 202 of the one or more explosive materials 104 causes at least some of the charged particles 118 to be released from the charged particle intercalated graphite 102. In some examples, the exfoliation deintercalates at least 1% of the charged particles 118 in the charged-particle intercalated graphite 102. For example, the released charged particles 222 of FIG. 2 may correspond to at least 1% of the charged particles 118 in the charged-particle intercalated graphite 102 of FIGS. 1A and 1B. In other examples, the exfoliation deintercalates less than 1% of the charged particles 118 in the charged-particle intercalated graphite 102.

The detonation 202 of the one or more explosive materials 104 is configured to accelerate 226 (acceleration indicated by a dotted arrow) the released charged particles 222 to produce EM energy 228 (e.g., EM radiation, EM waves, an EMP . . . etc.). For example, in some implementations, mechanical energy from a charge blast from the detonation 202 of the one or more explosive materials 104 accelerates the released charged particles 222. Acceleration of the released charged particles 222 causes the released charged particles 222 to emit (e.g., produce) the EM energy 228. The EM energy 228 from acceleration of each of the released charged particles 222 collectively corresponds to an EMP.

Thus, the apparatus 100 of FIGS. 1A and 1B is configured to generate an EMP using one or more explosive materials 104 disposed within a region defined by charged-particle intercalated graphite by liberating and accelerating charged particles of the charged-particle intercalated graphite. The EMP may include substantial EM energy within a wide range of frequencies (e.g., within the radio frequency (RF) spectrum). For example, the EMP may include substantial energy within microwave frequencies and non-microwave frequencies. Electronic components may be more susceptible to damage responsive to EM energy having particular frequencies, such as microwave frequencies. In some examples, the frequency spectrum of the EMP is tuned using a hollow conductor (e.g., a resonant cavity) to produce an EMP that is more effective at damaging electronic components.

Figure 3A:
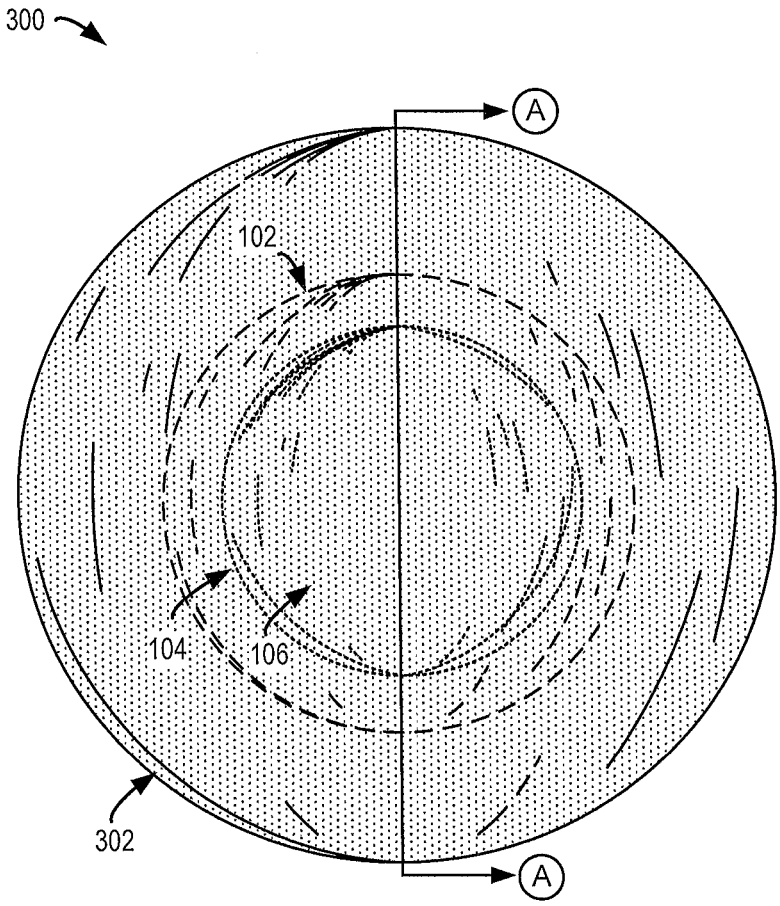
FIG. 3A illustrates a front view of an example of an apparatus that includes charged-particle intercalated graphite, one or more explosive materials, and a resonant cavity.
Figure 3B:
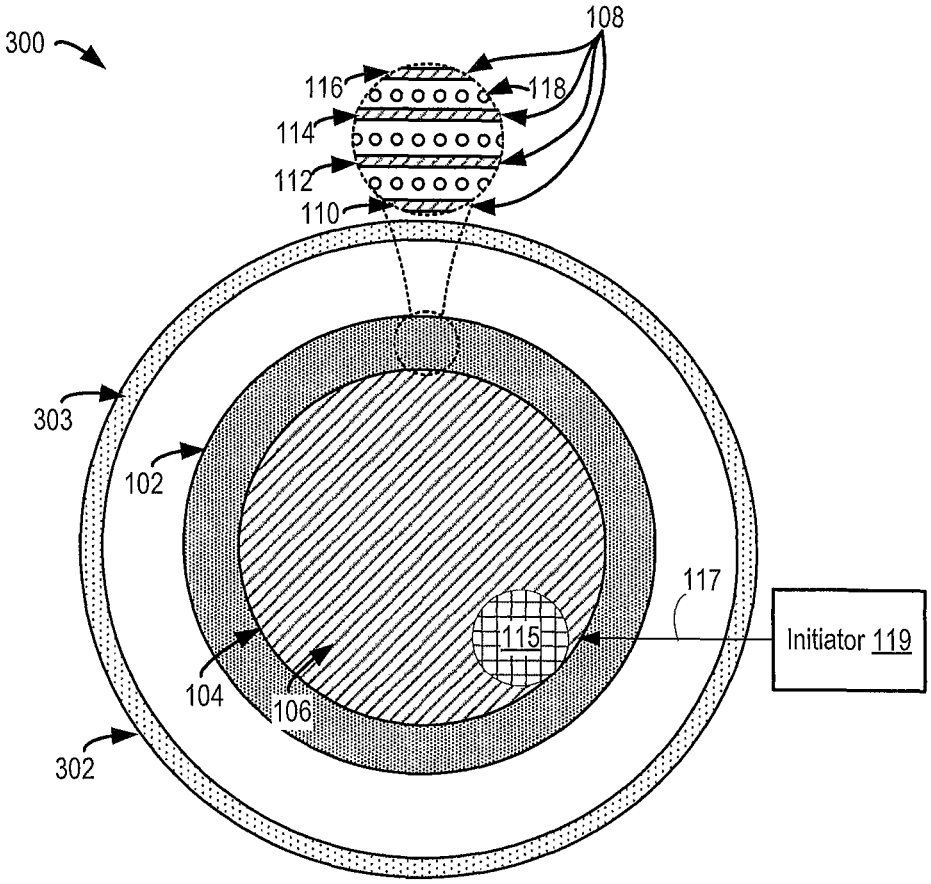
FIG. 3B illustrates a cross-sectional view of the apparatus of FIG. 3A along line A-A of FIG. 3A.

FIGS. 3A and 3B depict different views of an apparatus 300 that includes an example of a resonant cavity 302. The resonant cavity 302 includes a cavity wall 303. In some examples, the cavity wall 303 is formed of metal or other suitable electrical conductor. In the example illustrated in FIGS. 3A and 3B, the resonant cavity 302 is formed in the shape of a sphere. However, in other examples the resonant cavity 302 may be formed in a shape other than a sphere. In some examples, the resonant cavity 302 is arranged in a cylindrical shape or a box shape. During use of the apparatus 300, detonation of the one or more explosive materials 104 produces a blast-wave front that propagates toward the cavity wall 303. The blast-wave front travels slower than EM energy. The apparatus 300 is configured to confine and cause amplification of (or self-reinforcement of) particular frequencies of the EM energy 228 by resonance prior to the blast-wave front reaching the cavity wall 303. In some examples, the particular frequencies may correspond to microwave frequencies. In these examples, the resonant cavity 302 exhibits resonance at microwave frequencies, thereby causing amplification of microwave frequencies of the EM energy 228 emitted by the released charged particles 222. When the blast-wave front reaches the cavity wall 303, the cavity wall 303 ruptures, releasing an EMP corresponding to the particular frequencies of the EM energy confined and amplified by the resonant cavity 302. Thus, the EMP generated by the apparatus 300 is tuned to the particular frequencies confined and amplified by the resonant cavity 302.

Figure 4:
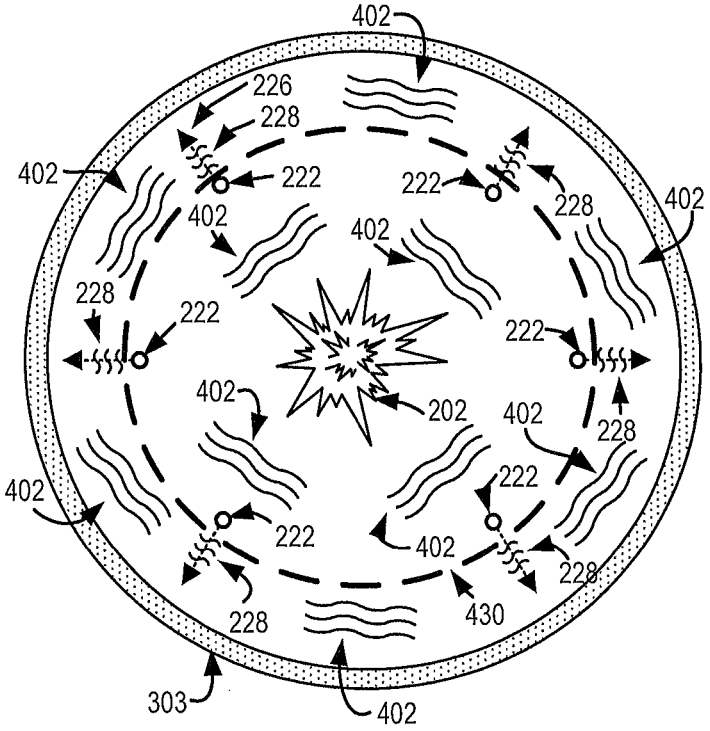
FIG. 4 illustrates an example of detonation of the one or more explosive materials of FIGS. 3A and 3B and electromagnetic energy produced by acceleration of charged particles released by the charged-particle intercalated graphite of FIGS. 1A and 1B responsive to the detonation.

To illustrate, FIG. 4 depicts a blast-wave front 430 (indicated using a dashed line) responsive to the detonation 202 of the one or more explosive materials 104 of FIGS. 3A and 3B. Force from the detonation 202 releases charged particles (e.g., the released charged particles 222) from the charged particle intercalated graphite 102 and accelerates the released charged particles 222 to produce the EM energy 228 as described above with reference to FIGS. 1A, 1B, and 2 prior to the blast-wave front 430 reaching the cavity wall 303. Additionally, the resonant cavity 302 is configured such that, prior to the blast-wave front 430 reaching the cavity wall 303, the particular frequencies of the EM energy 228 from acceleration of the released charged particles 222 bounce back and forth within the resonant cavity 302 at the resonant frequencies of the resonant cavity 302 (e.g., at the particular frequencies), causing EM waves 402 (e.g., standing waves) having the resonant frequencies to build up inside the resonant cavity 302. For example, when the resonant frequencies include microwave frequencies, the microwave frequencies of the EM energy 228 from acceleration of the released charged particles 222 bounce back and forth within the resonant cavity 302, resulting in the EM waves 402 having microwave frequencies. Within the time that it takes for the blast-wave front 430 to reach the cavity wall 303, the EM waves 402 corresponding to the particular frequencies oscillate the released charged particles 222 at the particular frequencies supported by the resonant cavity 302, thereby causing the released charged particles 222 to emit additional EM energy that causes additional build-up of the EM waves 402 within the resonant cavity 302. The EM waves 402 having the particular frequencies continue to build up within the resonant cavity 302 until the blast-wave front 430 reaches the resonant cavity 302, causing the resonant cavity 302 to shatter, rupture, or otherwise break apart and release the EM energy built up or stored in the resonant cavity 302 (e.g., from the EM waves 402). The EM energy released by the resonant cavity 302 (e.g., from the EM waves 402) corresponds to an EMP having the particular frequencies supported by the resonant cavity.

Thus, the apparatus 300 generates an EMP that is tuned to particular frequencies based on the dimensions of the resonant cavity, resulting in a narrowband EMP. As described above, the apparatus 300 may produce an EMP tuned to particular frequencies at which electronic components are more susceptible to damage.

Figure 5:
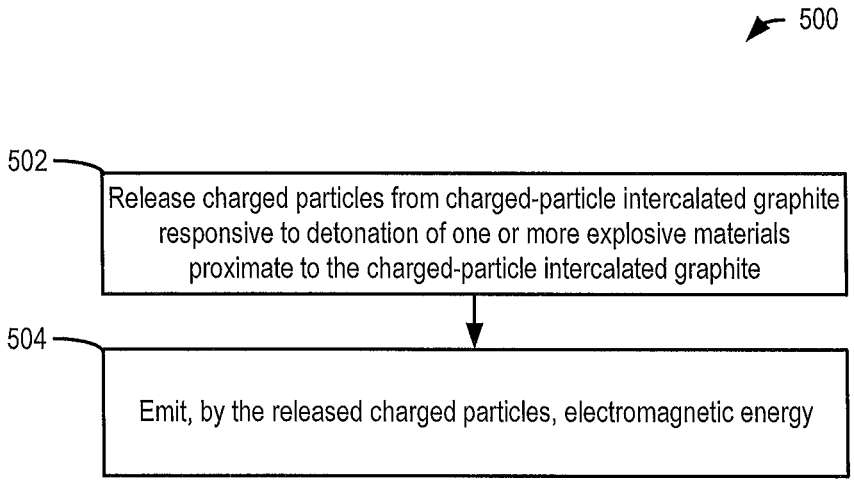
FIG. 5 is a flow chart of a method of producing an EMP.

FIG. 5 illustrates a method 500 for generating an EMP. In some examples, the method 500 is performed by the apparatus 100 of FIGS. 1A, 1B or the apparatus 300 of FIGS. 3A, 3B. The method 500 includes, at 502, releasing charged particles from charged-particle intercalated graphite responsive to detonation of one or more explosive materials proximate to (e.g., within a region defined by) the charged-particle intercalated graphite. In some examples, the charged-particle intercalated graphite corresponds to the charged-particle intercalated graphite 102 described above with reference to FIG. 1A, 1B, 2, 3A, 3B, or 4. Additionally or alternatively, in some examples, the one or more explosives correspond to the one or more explosive materials 104 described above with reference to FIG. 1A, 1B, 2, 3A, 3B, or 4. The detonation may correspond to detonation described above with reference to FIG. 1A, 1B, 2, 3A, 3B, or 4. For example, the detonation may correspond to the detonation 202 described above with reference to FIG. 2 or 4. The charged particles may be released from the charged-particle intercalated graphite responsive to the detonation as described above with reference to FIG. 1A, 1B, 2, 3A, 3B, or 4. For example, charged-particle intercalated graphite may undergo exfoliation (e.g., mechanical exfoliation, thermal exfoliation, or a combination thereof) responsive to detonation of the one or more explosive materials as described above with reference to FIG. 1A, 1B, 2, 3A, 3B, or 4, and the exfoliation may liberate or release the released charged particles 222 described above with reference to FIG. 2 or 4.

The method 500 includes, at 504, emitting, by the released charged particles, electromagnetic energy. For example, the released charged particles 222 may emit the EM energy 228 described above with reference to FIG. 1A, 1B, 2, 3A, 3B, or 4. In some examples, the released charged particles 222 are accelerated based at least in part on mechanical energy produced by the detonation as described above with reference to FIG. 1A, 1B, 2, 3A, 3B, or 4. The EM energy 228 is emitted responsive to the acceleration of the released charged particles. For example, accelerating the released charged particles 222 based on mechanical energy from the detonation may produce the EM energy 228 described above with reference to FIG. 2 or 4. The EM energy produced or emitted by the accelerated released charged particles may form an EMP.

In some implementations, the method 500 additionally includes initiating, by a detonator, the detonation responsive to an input at the detonator. For example, the detonator may correspond to the detonator 115 described above with reference to FIG. 1B and the input may correspond to the input 117 described above with reference to FIG. 1B.

In some implementations, the method 500 additionally includes resonating particular frequencies of the EM energy to tune the EMP. For example, the particular frequencies may include microwave frequencies to tune the EMP to particular frequencies within the microwave region of the EM spectrum. In some examples, the particular frequencies are supported by a resonant cavity at least partially surrounding the one or more explosive materials and the charged-particle intercalated graphite. For example, the particular frequencies may be supported by the resonant cavity 302 described above with reference to FIGS. 3A, 3B.

In conjunction with the described examples, an apparatus is disclosed that includes means for storing charged particles. For example, the means for storing charged particles may correspond to the charged-particle intercalated graphite 102 of FIG. 1A, 1B, 3A, or 3B.

The apparatus additionally includes means for detonating disposed within a region defined by the means for storing charged particles. For the example, the means for detonating may correspond to the one or more explosive materials 104 described above with reference to FIGS. 1A, 1B, 2, 3A, 3B, and the region may correspond to the region 106 of FIGS. 1A, 1B. In some examples, the means for detonating is configured to undergo non-nuclear explosive detonation as described above with reference to FIGS. 1A, 1B.

In some examples, the means for storing charged particles is configured to exfoliate in response to detonation of the means for detonating. For example, the means for storing charged particles may be configured to undergo exfoliation responsive to detonation of the means for detonating as described above with reference to exfoliation of the charged-particle intercalated graphite 102 responsive to the detonation 202. In some examples, the exfoliation causes release of charged particles from the means for storing charged particles and the detonation causes the released charged particles to accelerate to produce EM energy. For example, the exfoliation may cause release of the released charged particles 222 as described above with reference to FIGS. 1A, 1B, 2, 3A, 3B, and 4. As another example, the detonation causes the released charged particles to accelerate to produce EM energy as described above with reference to acceleration of the released charged particles 222 producing the EM energy 228.

In some implementations, the apparatus additionally includes means for reinforcing particular frequencies of EM energy produced by acceleration of charged particles released from the means for storing charged particles. For example, the means for reinforcing particular frequencies may correspond to the resonant cavity 302 of FIGS. 3A, 3B and the means for reinforcing particular frequencies may be configured to operate as described above with reference to FIG. 3A, 3B, 4, or 5.

The illustrations of the examples described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. For example, method steps may be performed in a different order than shown in the figures or one or more method steps may be omitted. Accordingly, the disclosure and the figures are to be regarded as illustrative rather than restrictive.

Moreover, although specific examples have been illustrated and described herein, it should be appreciated that any subsequent arrangement designed to achieve the same or similar results may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is submitted with the understanding that it will not be used to interpret or limit the scope or meaning of the claims. In addition, in the foregoing Detailed Description, various features may be grouped together or described in a single embodiment for the purpose of streamlining the disclosure. As the following claims reflect, the claimed subject matter may be directed to less than all of the features of any of the disclosed examples.

Examples described above illustrate but do not limit the disclosure. It should also be understood that numerous modifications and variations are possible in accordance with the principles of the present disclosure. Accordingly, the scope of the disclosure is defined by the following claims and their equivalents.

What is claimed is:

1. An apparatus comprising:

charged-particle intercalated graphite; and one or more explosive materials, the charged-particle intercalated graphite wrapped at least partially around the one or more explosive materials.

2. The apparatus of claim 1, wherein the one or more explosive materials are configured to detonate in response to activation energy from a detonator.

3. The apparatus of claim 1, wherein the one or more explosive materials include Trinitrotoluene (TNT), cyclotrimethylenetrinitramine (RDX), octogen (HMX), or a combination thereof.

4. The apparatus of claim 1, wherein the charged-particle intercalated graphite includes an alkali metal or bromine.

5. The apparatus of claim 1, wherein the charged-particle intercalated graphite is configured to undergo exfoliation in response to detonation of the one or more explosive materials.

6. The apparatus of claim 5, wherein the exfoliation releases charged particles from the charged-particle intercalated graphite, and wherein the detonation accelerates the released charged particles to produce electromagnetic energy.

7. The apparatus of claim 1, wherein the one or more explosive materials are configured to undergo non-nuclear explosive detonation.

8. The apparatus of claim 1, wherein the charged-particle intercalated graphite is fully wrapped around the one or more explosive materials.

9. The apparatus of claim 1, further comprising a resonant cavity, wherein the one or more explosive materials and the charged-particle intercalated graphite are disposed within the resonant cavity.

10. The apparatus of claim 9, wherein the resonant cavity is configured to support particular frequencies of electromagnetic energy produced by acceleration of charged particles released from the charged-particle intercalated graphite.

11. The apparatus of claim 10, wherein the particular frequencies include microwave frequencies.

12. A method of generating an electromagnetic pulse, the method comprising:

releasing charged particles from charged-particle intercalated graphite responsive to detonation of one or more explosive materials around which the charged-particle intercalated graphite is at least partially wrapped; and emitting, by the released charged particles, electromagnetic energy.

13. The method of claim 12, further comprising initiating, by a detonator, the detonation responsive to an input at the detonator.

14. The method of claim 12, wherein the released charged particles are accelerated based at least in part on mechanical energy produced by the detonation.

15. The method of claim 14, wherein the electromagnetic energy is emitted responsive to the acceleration of the released charged particles.

16. An apparatus, comprising:

means for storing charged particles; and means for detonating, the means for storing charged particles wrapped at least partially around the means for detonating.

17. The apparatus of claim 16, wherein the means for storing charged particles is configured to undergo exfoliation in response to detonation of the means for detonating.

18. The apparatus of claim 17, wherein the exfoliation releases charged particles from the means for storing charged particles, and wherein energy from the detonation accelerates the released charged particles to produce electromagnetic energy.

19. The apparatus of claim 18, further comprising means for causing particular frequencies of the electromagnetic energy to self-reinforce.

20. The apparatus of claim 16, wherein the means for detonating is configured to undergo non-nuclear explosive detonation.

* * * * *